US006560429B2

(12) United States Patent
Bares et al.

(10) Patent No.: US 6,560,429 B2
(45) Date of Patent: May 6, 2003

(54) APPARATUS AND METHOD FOR DISPENSING TONER FROM A CONTAINER TO AN IMAGE DEVELOPMENT STATION OF AN ELECTROSTATOGRAPHIC PRINTER

(75) Inventors: Jan Bares, Webster, NY (US); Jerry E. Livadas, Webster, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/956,630

(22) Filed: Sep. 20, 2001

(65) Prior Publication Data

US 2003/0053826 A1 Mar. 20, 2003

(51) Int. Cl.[7] ..... G03G 15/08
(52) U.S. Cl. ..... 399/253; 399/258; 399/292
(58) Field of Search ..... 399/222, 292, 399/252–256, 258–263

(56) References Cited

U.S. PATENT DOCUMENTS 6,201,941 B1 * 3/2001 Kasahara et al. ..... 399/258
6,304,739 B1 * 10/2001 Katsuyama et al. ..... 399/262
6,393,241 B1 * 5/2002 Matsumoto et al. ..... 399/258

* cited by examiner

*Primary Examiner*—William J. Royer

(57) ABSTRACT

An apparatus and method for dispensing toner in an electrostatographic printer includes apparatus for drawing ambient air in a vertical direction, preferably upwards, through a relatively large toner container. The air-flow is sufficient to fluidize the toner in the toner container and thereby prevent compaction. Such fluidization is optionally supplemented by the action of an auger or propeller mechanism mounted within the toner container. During rotation of the auger/propeller, the toner is lifted and thereby further prevents toner compaction.

15 Claims, 7 Drawing Sheets

APPARATUS AND METHOD FOR DISPENSING TONER FROM A CONTAINER TO AN IMAGE DEVELOPMENT STATION OF AN ELECTROSTATOGRAPHIC PRINTER

CROSS-REFERENCE TO RELATED APPLICATIONS

Reference is made to the commonly assigned U.S. patent application Ser. No. 09/956,629, filed concurrently herewith and entitled "Apparatus and Method for Fluidizing Toner in a Storage Container".

FIELD OF THE INVENTION

The present invention relates to improvements in methods and apparatus for dispensing fresh toner to an image development station in an electrostatographic copier/printer or the like.

BACKGROUND OF THE INVENTION

In electrostatographic copiers and printers, pigmented thermoplastic particles, commonly known as "toner," are applied to latent electrostatic images to render such images visible. Often, the toner particles are mixed with and carried by somewhat larger particles of magnetic material. During the mixing process, the magnetic carrier particles serve to triboelectrically charge the toner particles to a polarity opposite that of the latent charge image. In use, the development mix is advanced, typically by magnetic forces, from a sump to a position in which it contacts the latent charge image. The relatively strong electrostatic forces associated with the charge image operate to strip the toner from the carrier, causing the toner to remain with the charge image. Thus, it will be appreciated that, as multiple charge images are developed in this manner, toner particles are continuously depleted from the mix and a fresh supply of toner must be dispensed from time-to-time in order to maintain a desired image density. Usually, the fresh toner is supplied from a toner supply bottle mounted upside-down, i.e., with its mouth facing downward, at one end of the image-development apparatus. Under the force of gravity, toner accumulates at the bottle mouth, and a metering device, positioned adjacent the bottle mouth, operates to meter sufficient toner to the developer mix to compensate for the toner lost as a result of image development. Usually, the toner-metering device operates under the control of a toner concentration monitor that continuously senses the ratio of toner to carrier particles in the development mix.

It is well known that toner is a powdery substance that exhibits a considerable degree of cohesiveness and, hence, relatively poor flowability. Since the force of gravity alone does not usually suffice in causing toner to flow smoothly from the mouth of an inverted toner bottle, other supplemental techniques have been used to "coax" the toner from the bottle. For example, flow additives, such as silica and the like, have been added to the mix to reduce the troublesome cohesive forces between toner particles. See, e.g., the disclosure of U.S. Pat. No. 5,260,159 in which a "fluidization" agent is added to a developer mix in a development sump to assist the movement of developer therein. While beneficial to a more consistent flow of developer, such substances influence other performance attributes of the development process and their effectiveness is therefore constrained. Automatically operated stirring devices or augers mounted within a horizontally oriented toner container, and thumping or vibrating devices connected to such containers have also been used to urge toner from its rest position towards an outlet or exit port. Such mechanical techniques work well when the toner container is relatively small (e.g., 2 to 5 liters) and the height of the toner column above the exit port is relatively low (e.g., lower than about 15 cm.) so as to avoid gravity-assisted compaction of the toner which further compromises flowability. But, as the size of the toner bottle or container increases, e.g., to accommodate high speed and wide format printing in which toner is consumed at extraordinarily fast rates, the above-noted flow-enhancing techniques have been found to be inadequate. In such high toner-consumption situations, toner sumps of the order of tens of liters are desirable in order to eliminate the need for frequent toner bottle replacements. The weight of the toner in these large volume containers is too great for conventional rappers and vibrators to keep the toner flowing through the outlet, and most of these devices only exacerbate the toner-packing problem.

In U.S. Pat. No. 5,570,170, there is disclosed an apparatus for dispensing single-component, electrically conductive magnetic toner particles from a pair of inverted toner bottles mounted above a conventional development station in an electrostatic printing apparatus. A screen positioned at the mouth of each bottle serves to prevent toner flow from the bottle whenever the toner is piled up atop the screen. The toner-dispensing apparatus includes a pair of gas-permeable, but toner-impermeable, tubes that extend upwardly, into each bottle, a distance of about 30–60% of the height of the bottles. On command, pressurized gas is introduced into the tubes. As the gas passes through the tubes and into the toner bottles, it acts to fluidize the toner in the bottle in the vicinity of the bottle's outlet, thereby enabling the toner to flow smoothly through the screen mesh and into the development station of the printer, as needed. In effect, the screen acts as a gate to prevent toner flow into the development station until the toner above the screen is fluidized. A microprocessor controls the application of pressurized gas to each of the bottles, switching from one bottle to the other as one-bottle empties. By using two bottles, the machine operator can replace an empty bottle without shutting down the machine.

While the apparatus disclosed in the above patent may be advantageous in some respects in selectively dispensing magnetic toner to an image-development station, it is disadvantageous in that it requires one or more sources of compressed gas in order to effect the necessary fluidization of the toner mass in order to achieve passage of the toner through the metering screen at the mouth of each toner bottle. Further, to prevent toner dust from being blown out of the development station during toner dispensing, a vacuum must be created in the mouth of the development station. This dusting problem can be especially problematic as the size of the toner bottle increases to accommodate high speed and large format printing.

SUMMARY OF THE INVENTION

In view of the foregoing discussion, an object of this invention is to provide an improved method and apparatus for dispensing toner from high tower sumps or hoppers of the type used in high speed and/or high volume printing applications.

In accordance with a preferred embodiment of the invention, there is provided a toner-dispensing apparatus comprising a relatively large (e.g. 25–50 liters), vertically oriented container adapted to receive a fresh supply of toner. The toner container is adapted to be permanently installed within the framework of an electrostatographic printer or the like, and it is shaped somewhat like a funnel, having a lower portion with walls that converge towards a relatively small toner-outlet port in the container's lowest-most portion. The toner-outlet port is positioned directly above an auger that serves, when rotating, to transport toner from the outlet port of the toner container to the housing of a conventional image-development station of the printer. One or more toner-impervious air-inlet port(s), as provided, for example, by a screened opening, is provided in the container wall in the vicinity of the toner-outlet port. The upper portion of the toner container is operatively coupled to a vacuum source, preferably via a toner-impermeable, air-permeable filter. The upper portion of the container defines a normally closed toner-refill port through which fresh toner can be added manually to the container. When activated, the vacuum source serves to draw air from the container through the aforementioned filter, thereby lowering the pressure in the container and causing air to be drawn into the container through the air inlet port at the base of the container. Thus, as the air entering the container through the air-inlet port rises towards the vacuum source at the top of the container, it acts to lift and tumble the intervening toner particles, thereby fluidizing or aerating the entire toner mass within the container. Such fluidization serves to prevent any compaction of the toner within the container, as would normally occur in a toner container of the size contemplated for use in the invention, allowing the toner to flow uninterrupted through the container's toner outlet port and onto the underlying toner-transport auger. Preferably, the filter through which the air is evacuated from the container is vibrated, either continuously or intermittently, to prevent the build-up of any toner deposit occurring while the toner-fluidizing vacuum is applied. In accordance with another preferred embodiment, the air entering the air-inlet port(s) at the base of the toner container is supplied from the housing of the image-development station. By this arrangement, any toner dusting that might occur for any reason at the toner applicator/image-recording element interface is minimized.

According to alternate embodiments, toner fluidization within the container via the vacuum applied to the container as described above is supplemented by either a vertically oriented rotatable auger that, when rotating, acts to convey toner upwardly, towards the top of the aforementioned container, or by a vertically oriented rotatable shaft that supports a plurality of outwardly-extending propellers that serve, while the support shaft is rotating, to drive the toner upwardly within the container and thereby assist in the toner fluidization process.

In accordance with another aspect of the invention, a method is provided for enhancing the flowability of toner particles through an exit port located in the base of a vertically oriented toner storage hopper. Such method comprises the steps of fluidizing the toner mass above the port either by directing a gas in a vertical direction, either upwards or downwards, through the toner mass while dispensing toner from the hopper outlet, and optionally by simultaneously mechanically agitating the mass with propellers or augers that rotate about a vertical axis within the toner container.

An advantageous technical effect of the invention is that fresh toner can be dispensed with enhanced reliability from a relatively large storage container in which the toner, but for the invention, would most certainly compact from its weight and from internal machine vibrations, and thereby resist movement from the container's outlet port.

The invention and its advantages will become better understood from the ensuing detailed description of preferred embodiments, reference being made to the accompanying drawings in which like reference characters denote like parts.

DETAILED DESCRIPTION OF THE INVENTION

Figure 1:
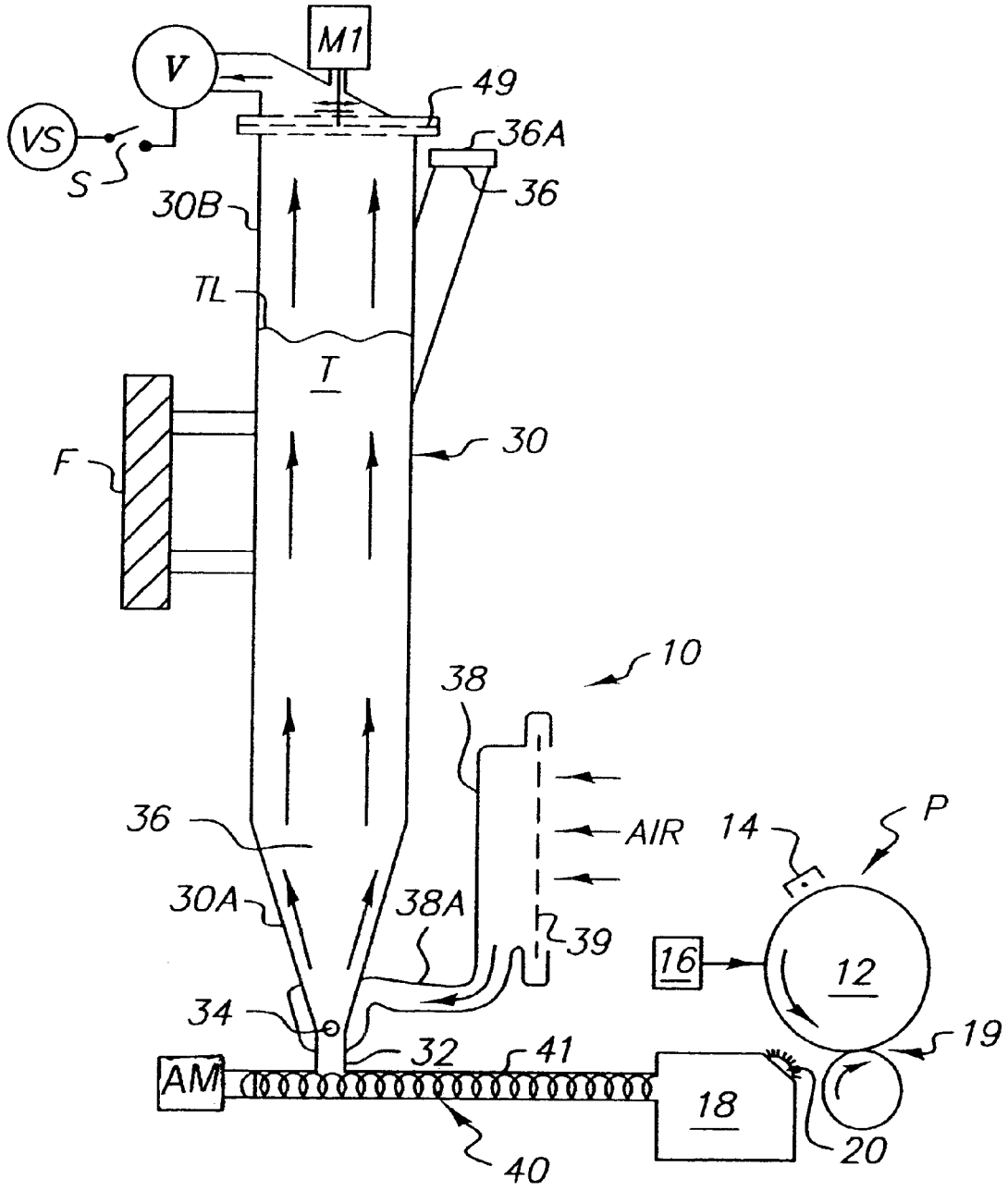
FIGS. 1–5 are schematic illustrations of various preferred embodiments of the invention.

Referring now to the drawings, FIG. 1 schematically illustrates a preferred embodiment of a toner dispensing apparatus 10 adapted for use with an electrostatographic printer P. The latter is of conventional design comprising, for example, an endless photoconductive recording element 12, typically in the form of a drum, on which electrostatic images are formed by the well known electrostatographic process. Briefly, such process comprises the steps of uniformly charging the outer surface of recording element 12 at a primary charging station 14 as the recording element 12 moves therepast, and then, at an exposure station 16, imagewise exposing the uniformly charged surface to actinic radiation adapted to imagewise discharge the charged surface. The charge image thus formed is subsequently rendered visible via the application of toner particles at an image-development station 18. The toned image is then transferred to a receiver sheet at a transfer station 19 and the image-forming process is repeated. The image-development station 18 commonly comprises a rotating "magnetic brush" 20 that operates, in a well known manner, to transport a development mixture of toner and carrier particles from a sump to the surface of the charge image borne by the outer surface of the recording element 12. As noted earlier herein, as the development mixture contacts the charge image, the toner is stripped from the carrier and applied to the charge image. Thus, toner is continuously depleted from the developer and must be replenished.

Still referring to FIG.1, the toner dispensing apparatus 10 of the invention comprises a relatively large volume (e.g. 25–50 liters), vertically oriented toner container 30 adapted to receive a fresh supply of toner T. As will be appreciated, such a container 30 is considerably larger (e.g. by a factor of 10 or more) than the volume of conventional toner bottles that are used to replenish toner to conventional document printers and copiers, such bottles being disposable after the contents has been emptied into the developer station sump. In contrast, the toner container 30 is designed to be permanently installed within the housing or frame F of the electrostatographic printer and, as illustrated, is preferably shaped somewhat like an elongated funnel, having a cylindrical upper portion 30B and lower portion 30A that converges towards a relatively small toner-outlet port 32 in the container's lowest-most portion. The toner-outlet port 32 is preferably positioned directly above a rotatable auger mechanism 40 having an auger 41 that serves, when the auger 41 is rotated by an auger motor AM, to transport toner from the toner-outlet port 32 of the toner container 30 to the sump housing of image-development station 18. One or more toner-impervious air-inlet port(s) 34 is provided in the container wall 36 in the vicinity of the toner-outlet port 32. Air can enter the air-inlet port(s) 34 through a conduit 38A connected to air inlet plenum 38 having an air-pervious filter screen 39 that serves to filter out air-borne particles and other contaminants.

The cylindrically shaped upper portion 32B of toner container 30 is operatively coupled to a vacuum source V, such as a vacuum pump or the like, preferably via a toner-impermeable, air-permeable screen or filter 49. The vacuum source V is electrically operated and is selectively energizeable via a switch S connected to a voltage source VS. The upper portion 30B of the toner container 30 defines a normally closed toner-refill port 36 through which fresh toner can be added manually to the toner container 30 to establish a desired initial toner level TL. Normally, port 36 is closed by a cap 36A. When activated by switch S, the vacuum source V serves to draw air from the toner container 30 through filter 49. As air in the toner container 30 is evacuated, filtered clean air is drawn into the toner container 30 through the air inlet port 34 and filter 39. Thus, as the air entering the toner container 30 through the air-inlet port 34 rises towards the vacuum source V at the top of the toner container 30, it acts to lift and tumble the intervening toner particles, thereby fluidizing or aerating the entire toner mass within the toner container 30. Such fluidization serves to prevent any compaction of the toner within the toner container 30, as would normally occur in a toner container of the size contemplated for use in the invention, allowing the toner to flow uninterrupted through the container's toner outlet port 32 and onto the underlying toner-transport auger mechanism 40. The toner transport auger mechanism 40 includes an auger 41 which then serves to transport toner from the toner container 30 to the image-development station 18. Preferably, the filter 49 through which the air is evacuated from the toner container 30 is vibrated via a vibrating actuator of a suitable motor M1, the latter being operated either continuously or intermittently, to prevent the build-up of any toner deposit occurring while the toner-fluidizing vacuum is applied.

As a result of the above-described construction, the aforementioned disadvantages of the prior art are avoided. Specifically, fresh toner can be dispensed with enhanced reliability from a relatively large storage container in which the toner, but for the invention, would most certainly compact from its weight and from internal machine vibrations, and thereby resist movement from the container's outlet port. Further, fluidization of the toner is achieved without the use of any external sources of compressed gas, as is required by the aforementioned prior art apparatus, and the apparatus of the invention requires no auxiliary vacuum source at the mouth of the development station to prevent toner dust from being blown out of the development station during toner dispensing.

Figure 2:
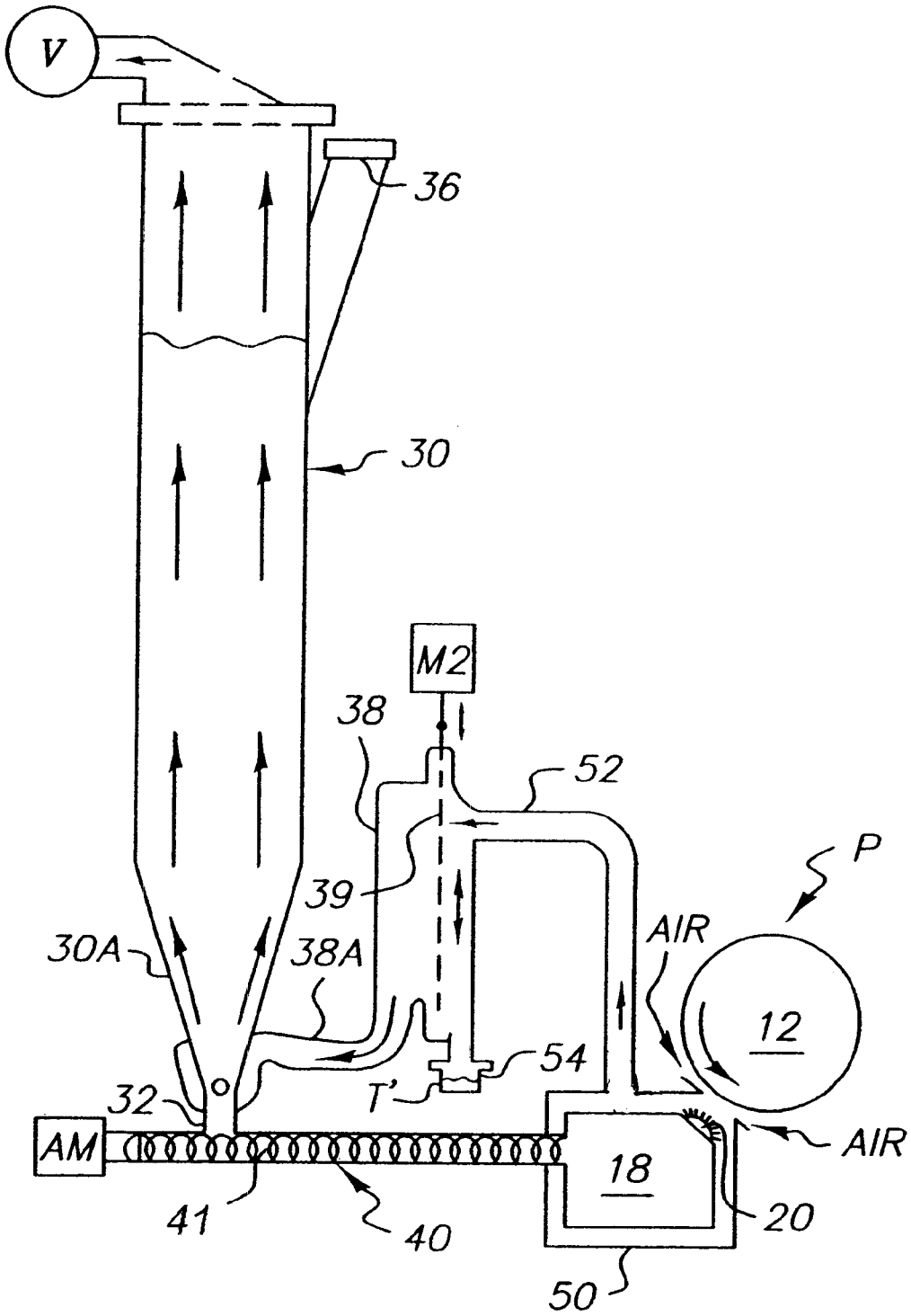

Referring now to FIG. 2, the FIG. 1 apparatus is shown to be modified by the inclusion of a dust shield 50 that surrounds the development station 18. As shown, the interior of the dust shield 50 is pneumatically coupled to the intake of inlet plenum 38 via an air duct or conduit 52. Thus, when the vacuum source V is energized, ambient air in the vicinity of the magnetic brush 20 enters the dust shield 50 and is directed to the entrance of plenum 38. Preferably, the filter screen 39 is connected to the actuator of a vibrating motor M2; the vibrating motion of the filter screen 39 operates to rid the filter screen 39 of toner dust particles that will accumulate on the filter screen 39 when the vacuum source V is applied. Toner particles T' that fall from the filter screen 39 as a result of its accumulate in a tray 54 that is releasably mounted on the printer housing directly beneath the filter screen 39. By this arrangement, any tendency for toner particles or dust to escape the confines of the development station 18 will be minimized.

Figure 3:
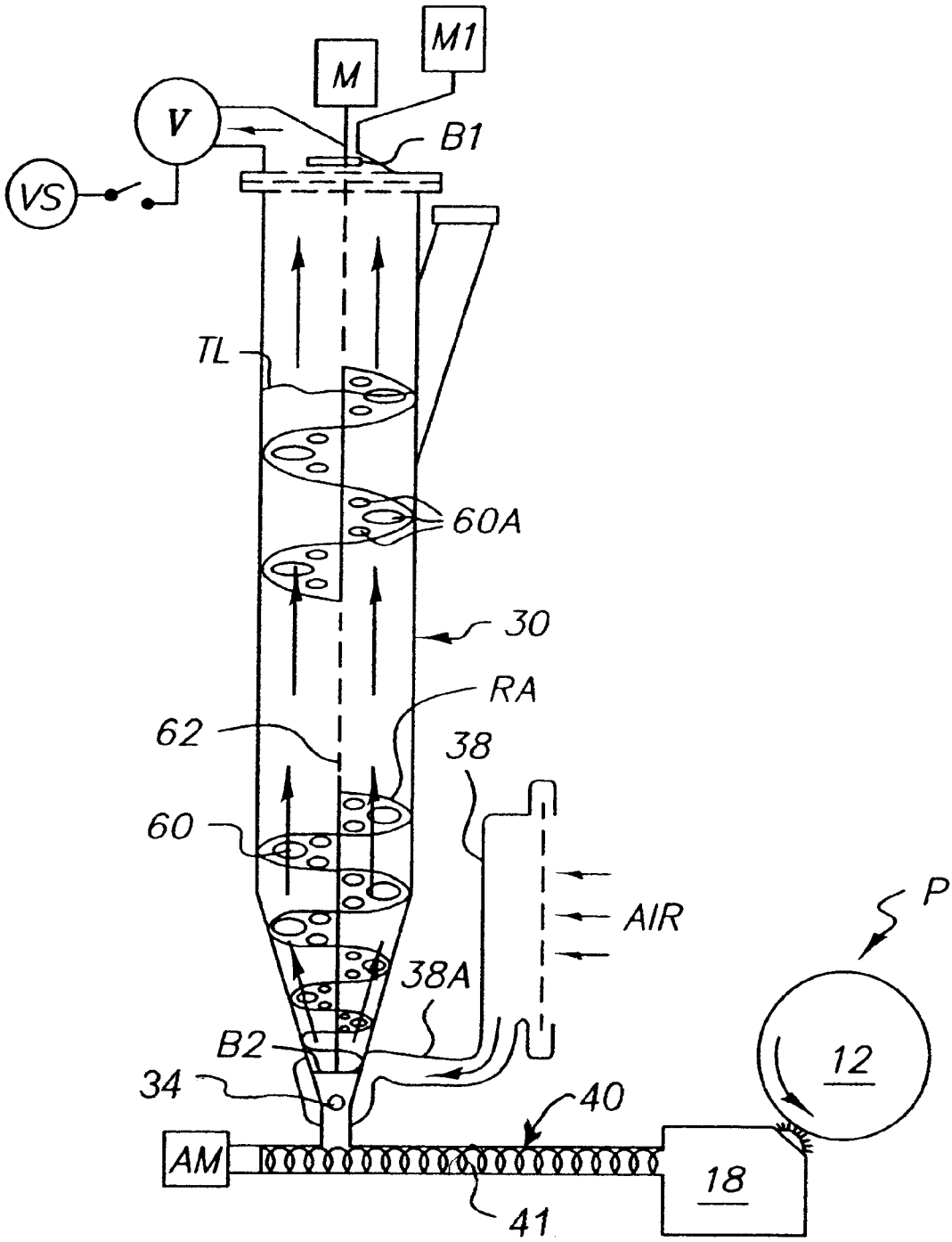
Figure 6:
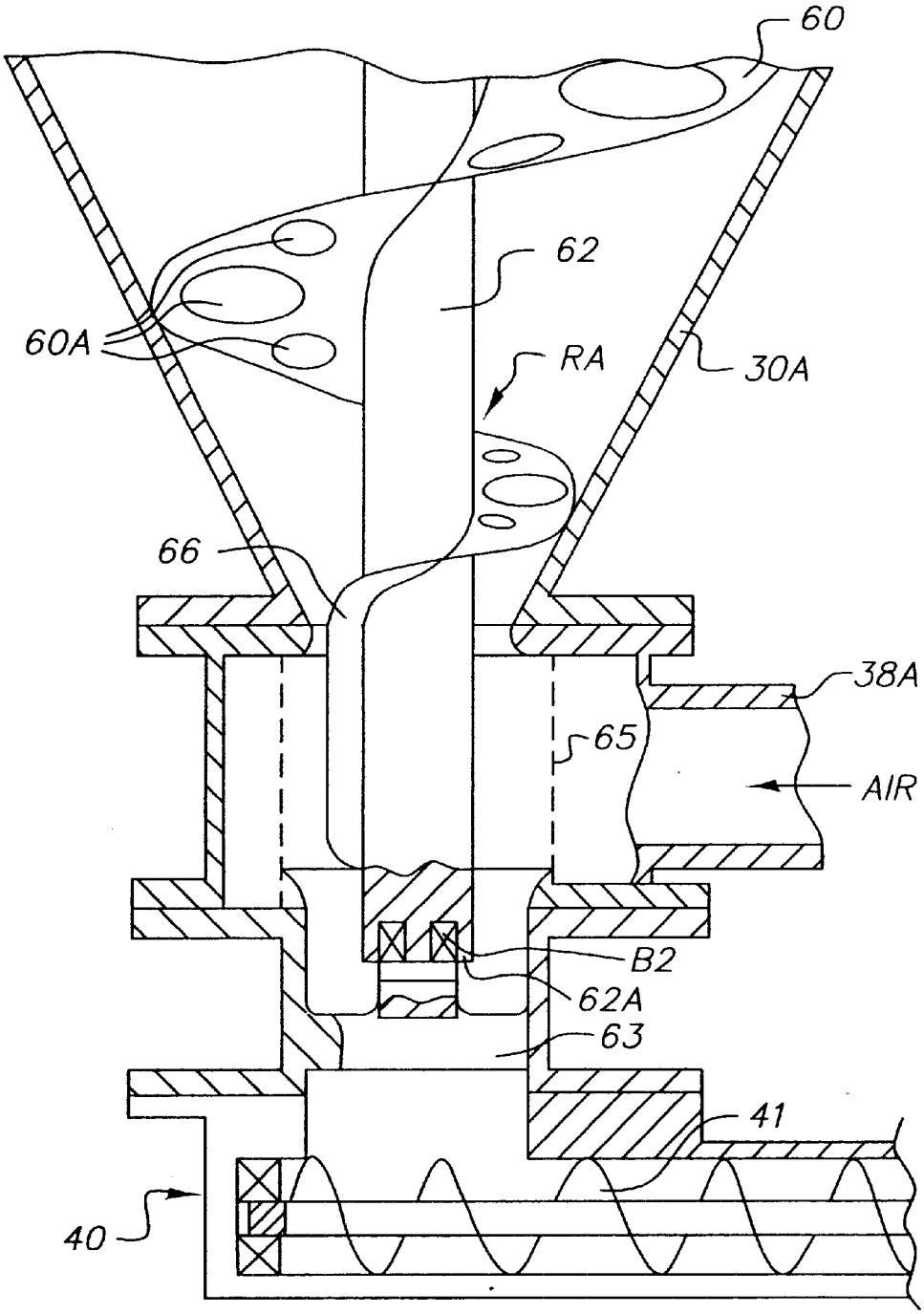
FIGS. 6 and 7 are enlarged views showing certain details of the embodiments of FIGS. 3, 4, and 5.

Referring now to FIG. 3, the toner fluidization effect achieved by the FIG. 1 apparatus is illustrated as being enhanced by a vertically disposed rotating auger RA. The latter comprises a helical auger blade 60 supported by a rotatably mounted shaft 62. Details of this auger mechanism are better shown in FIG. 6. Shaft 62 is supported at opposite ends by a pair of bearings B1, B2 mounted by a spider support 63 mounted within the toner container 30. Operation of the auger mechanism is controlled by a drive motor M that serves to rotate the auger blade 60 so that toner is lifted vertically within the toner container 30. A series of holes 60A formed in the auger blade 60 enable the lifted toner to be fall, under the force of gravity, downward into the toner container 30 to maintain the toner level substantially constant, at a level determined by the toner consumption of the printer. As shown in FIG. 6, the auger shaft 62 terminates in a flange or skirt 62A that surrounds and protects the bearing B2. Further, it is preferred that the ambient air drawn into the toner container 30 through entrance port(s) 34 be filtered by a cylindrically shaped screen 65 that concentrically surrounds shaft 62. Further preferred is that the auger blade 60 has a screen-sweeping paddle portion 66 that operates, while the auger blade 60 is rotating, to sweep particulate material from the surface of screen 65 and thereby maintain the screen 65 relatively clean at all times.

Figure 4:
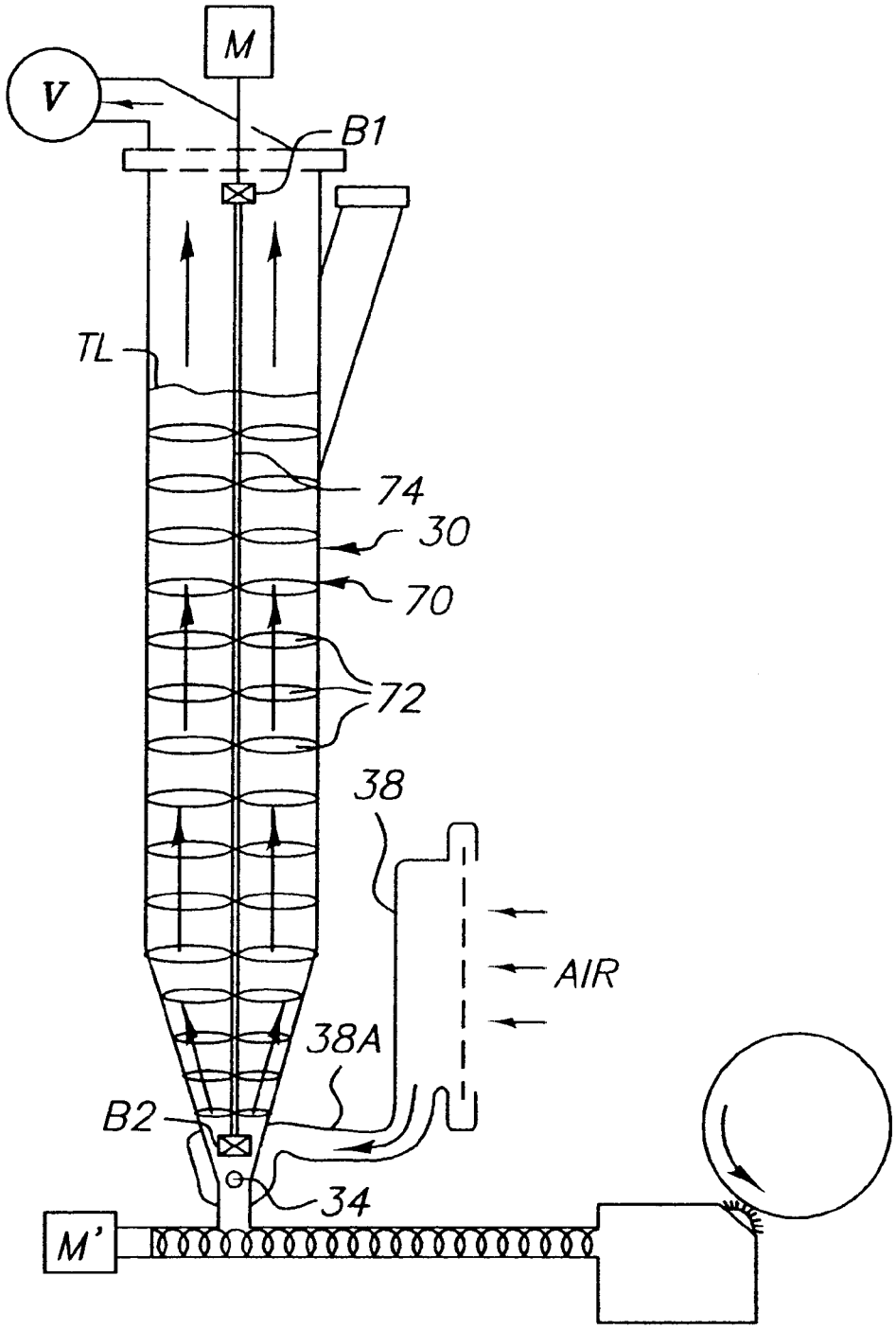

In an alternative embodiment shown in FIG. 4, the auger mechanism of FIG. 3 is replaced by a propeller arrangement 70 in which a series of propellers 72 extend radially outward from a rotatably mounted and drive shaft 74 selectively driven by a motor M. Each of the propellers 72 is suitably shaped to lift and propel toner particles slightly upwards within the toner container 30, thereby supplementing the fluidizing effect of the above-described vacuum system.

Figure 5:
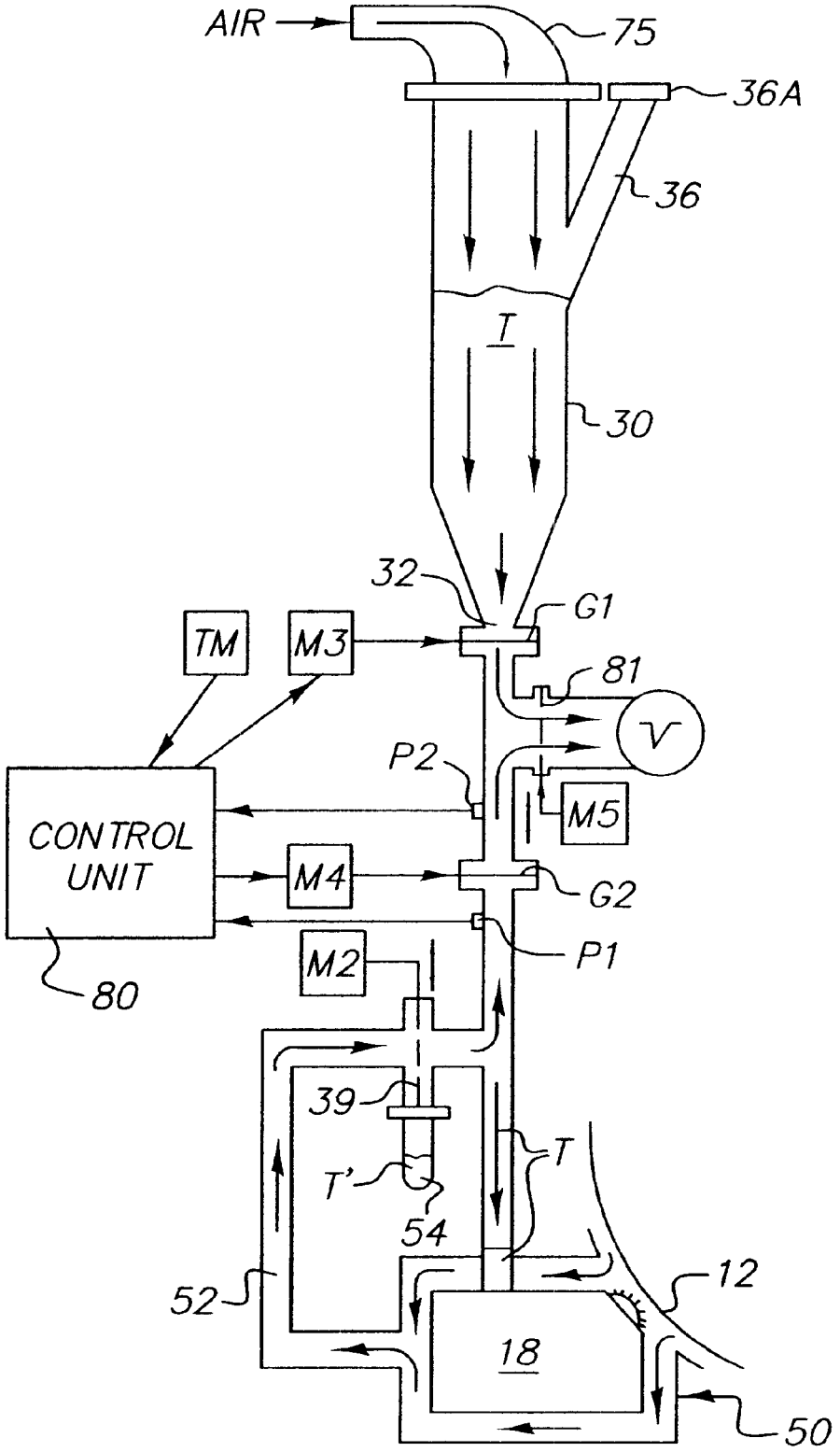
Figure 7:
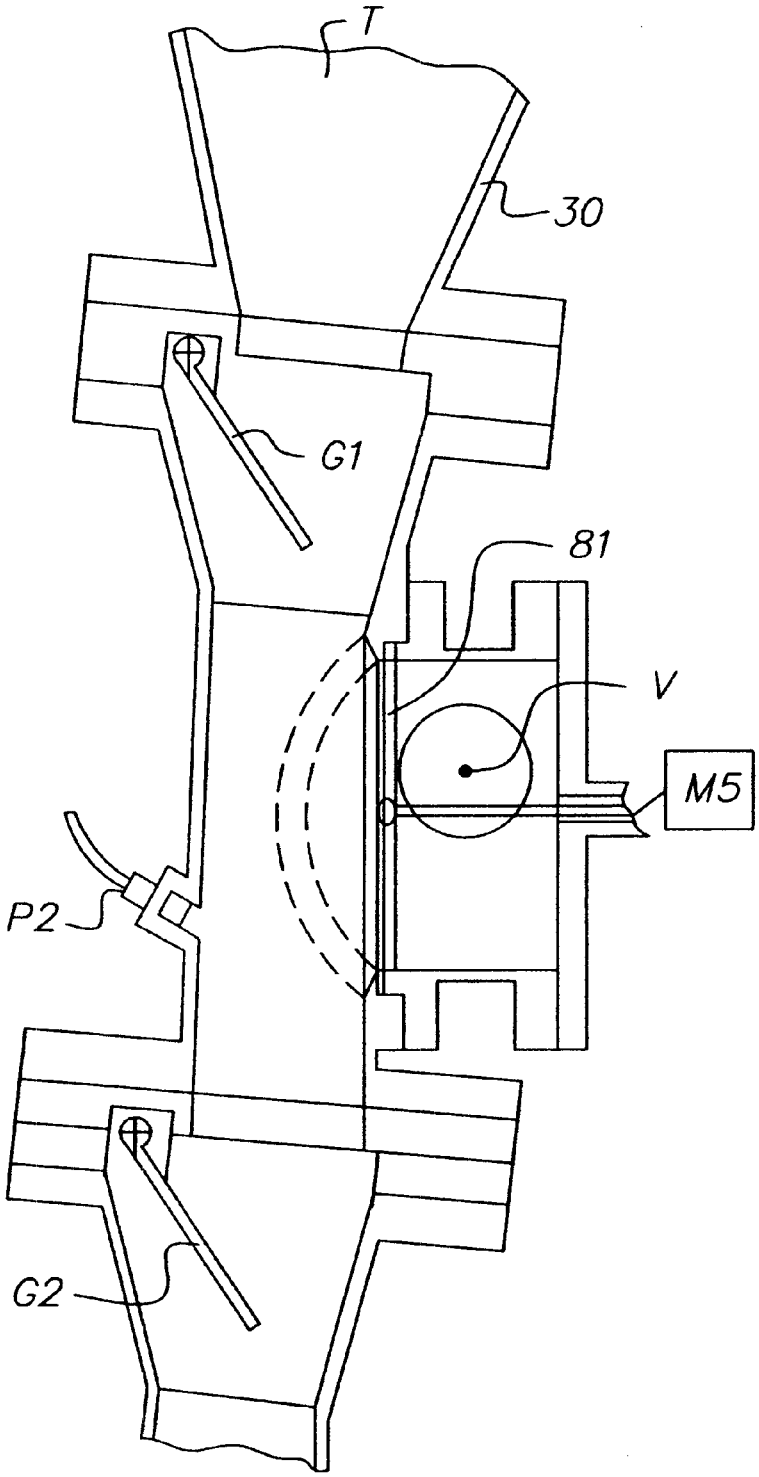

FIGS. 5 and 7 illustrate yet another embodiment of the invention in which fluidizing air is drawn through the toner container from the top down, rather than from the bottom up, as is the case of the FIGS. 1–4 embodiments. As shown, an air manifold 75 is provided atop toner container 30, and a vacuum source V is positioned between the toner container's outlet port 32 and toner entrance to the development station 18. A pair of gates G1 and G2, operating under the control of a suitably programmed control unit 80 and responsive to the actuators of motors M3 and M4 (also controlled by control unit 80), operate to control the flow of toner from toner container 30 to the development station 18. When no toner is being dispensed, gate G1 is closed. When the control unit 80 receives information from a toner concentration monitor TM indicating that fresh toner is required, it operates to close or adjust the position of gate G2 to prevent excessive suction from being applied to a dust shield 50 and activates the vacuum source V while opening gate G1. The downwardly flowing air through the toner container acts to fluidize the toner in the toner container 30. To determine the extent to which gate G2 needs to be closed, the control unit 80 compares the pressures sensed by a pair of pressure sensors P1 and P2 located on opposite sides of gate G2. Thus, the toner dispensed from toner container 30 is contained between gates G1 and G2 until the vacuum source is deactivated, at which time gate G1 is closed and gate G2 is opened to release the dispensed toner to the development station 18. The released toner may be applied directly to the toner sump of the development station 18, as shown, or it may be applied to a toner-transport auger mechanism, as described above, operating under control of the control unit 80. Each of the gates G1 and G2 may take the form of a pivotally mounted plate, as shown in FIG. 7, or they may take the form of a fine screen that is toner-impermeable unless the fluidizing vacuum is applied. Preferably, the vacuum source V is isolated from the dispensed toner by a filter or screen 81 that is vibrated or thumped by the vibrating actuator of a suitable motor M5 to prevent toner from accumulating. In this embodiment, the dust shield 50 is still used to draw toner dust from the vicinity of the development brush/recording element interface. As in the FIG. 2 embodiment, air-borne toner particles in conduit 52 are captured by a vibrating screen filter 39 and deposited in tray 54.

While the invention has been described in detail with reference to preferred embodiments, it will be understood that changes can be made without departing from the spirit of the invention. Such changes are intended to fall within the scope of the following claims.

What is claimed is:

1. Apparatus for dispensing toner in an electrostatographic printer, said apparatus comprising:

(a) a vertically oriented container for containing a fresh supply of toner, said container being adapted to be permanently mounted within a housing of said electrostatographic printer and having a lower portion defined by walls that converge towards a toner-outlet port located at the container's lowest-most point, said container having formed in said converging walls in the vicinity of said toner-outlet port at least one toner-impervious air-inlet port through which air can enter adjacent to said lowest-most point of said container;

(b) a selectively energizable toner transport device positioned directly below said toner-outlet port, said toner transport device operating, when energized, to transport toner that has passed through said toner-outlet port to an image-development station of said electrostatographic printer; and (c) a selectively energizable vacuum source, operatively connected to said container at a location vertically displaced from said toner outlet-port, said vacuum source operating, when energized, to evacuate air from the container that has entered the container through said at least one toner imprevious air-inlet port, whereby air entering the container through said at least one toner impervious air-inlet port rises upwardly towards the vacuum source and thereby fluidizes the entire toner mass within the container, allowing toner to flow uninterrupted through the container's toner-outlet port and into said toner transport device.

2. The apparatus as defined by claim 1 wherein said container is connected to said vacuum source via an intervening toner-impervious, air-pervious filter member.

3. The apparatus as defined by claim 2 wherein said filter member is vibrated to prevent the build-up of any toner deposit occurring while said vacuum source is energized.

4. The apparatus as defined by claim 1 wherein the air entering said container through said at least one toner impervious air-inlet port is supplied through a conduit connected to said image-development station of said electrostatographic printer, whereby any toner dusting that might occur in the vicinity of said image-development station is reduced.

5. The apparatus as defined by claim 4 wherein the air entering said container through said at least one toner impervious air-inlet port is filtered by an additional toner-impervious filter member.

6. The apparatus as defined by claim 5 wherein said additional toner-impervious filter member is vibrated to prevent build-up of any toner deposits.

7. The apparatus as defined by claim 1 further comprising a device for supplementing the toner fluidizing effect of said vacuum source.

8. The apparatus as defined by claim 7 wherein said supplementing device comprises a multi-blade propeller mounted on a rotatably mounted shaft extending in a vertical direction within said container, said shaft being selectively energizable to cause said multi-blade propeller to propel toner upwardly, in a direction away from said toner-outlet port.

9. The apparatus as defined by claim 7 wherein said supplementing device comprises a rotatably mounted auger extending in a vertical direction within said container, said auger being selectively energizable to advance toner upwardly, in a direction away from said toner-outlet port.

10. The apparatus as defined by claim 9 wherein said auger comprises a rotatably mounted, helical-shaped auger blade having a plurality of holes formed therein through which toner can fall, under the influence of gravity as said auger blade rotates.

11. A method for enhancing the flowability of toner particles through a toner-outlet port located in the base of a vertically oriented toner storage container, said method comprising the steps supporting a toner mass within said container, fluidizing the toner mass above said toner-outlet port by directing a gas in a vertical direction through said container, and simultaneously mechanically agitating the toner mass within said container.

12. The method as defined by claim 11 wherein said gas is directed upwardly through said container.

13. The method as defined by claim 11 wherein said gas is directed downwardly through said container.

14. The method as defined by claim 11 wherein the toner mass is mechanically agitated by rotating an auger blade within the contained toner mass about a vertical axis.

15. The method as defined by claim 11 wherein the toner mass is mechanically agitated by rotating a propeller blade within the contained toner mass about a vertical axis.

* * * * *